US008118643B2

(12) United States Patent
Sato et al.

(10) Patent No.: US 8,118,643 B2
(45) Date of Patent: Feb. 21, 2012

(54) METHOD OF DESCALING METAL WIRE ROD AND APPARATUS THEREFOR

(75) Inventors: Kazuyoshi Sato, Uozu (JP); Kinari Senda, Uozu (JP); Akio Yamazaki, Namerikawa (JP)

(73) Assignee: Senda Kensetsu Kabushiki Kaisha, Uozu-shi (JP)

( * ) Notice: Subject to any disclaimer, the term of this patent is extended or adjusted under 35 U.S.C. 154(b) by 385 days.

(21) Appl. No.: 12/309,606

(22) PCT Filed: Jul. 24, 2007

(86) PCT No.: PCT/JP2007/064520

§ 371 (c)(1),
(2), (4) Date: Apr. 22, 2009

(87) PCT Pub. No.: WO2008/013179

PCT Pub. Date: Jan. 31, 2008

(65) Prior Publication Data

US 2010/0015891 A1 Jan. 21, 2010

(30) Foreign Application Priority Data

Jul. 24, 2006 (JP) ..... 2006-200244

(51) Int. Cl.
*B24B 1/00* (2006.01)
*B24B 7/00* (2006.01)

(52) U.S. Cl. ..... 451/38; 451/60; 451/67

(58) Field of Classification Search ..... 451/36–40, 451/57, 59, 60, 65, 67
See application file for complete search history.

(56) References Cited

U.S. PATENT DOCUMENTS 3,628,295 A * 12/1971 Curtiss ..... 451/49
4,035,962 A * 7/1977 Ayers ..... 51/308
4,258,505 A * 3/1981 Scheiber et al. ..... 451/36
4,333,275 A * 6/1982 Bernot ..... 451/39

FOREIGN PATENT DOCUMENTS

JP 07204739 A * 8/1995

* cited by examiner

*Primary Examiner* — Dung Van Nguyen
(74) *Attorney, Agent, or Firm* — Kubovcik & Kubovcik

(57) ABSTRACT

An apparatus for removing scales from metal wires including: a liquid container tank 12 through which the metal wires 10 pass, mixing nozzles 14 disposed to allow the metal wirings to pass through the liquid container tank for injecting a high-pressure liquid toward the metal wires 10; a high-pressure pump 16 for feeding the high-pressure liquid to the mixing nozzles 14; and cyclone separators 20 which are slurry feeders for feeding a slurry of the liquid with which an abrasive scavenging agent is mixed to the mixing nozzles 14. The mixing nozzles 14 inject the slurry of the abrasive scavenging agent together with the high-pressure liquid so that the abrasive scavenging agent bombards the scales on the surfaces of the metal wires 10 to remove the scales. Provision is further made for the cyclone separators 20 to recover the liquid with which the abrasive scavenging agent is mixed, and separate the liquid and the abrasive scavenging agent from each other, and a wheel-type filter 40 for further separating the abrasive scavenging agent. The cyclone separators 20 feed the abrasive scavenging agent in slurry form to the mixing nozzles 14, and separate the liquid components.

5 Claims, 2 Drawing Sheets

METHOD OF DESCALING METAL WIRE ROD AND APPARATUS THEREFOR

TECHNICAL FIELD

This invention relates to a method of removing scales from metal wires for removing scales generated in a process of stretching the metal wires such as steel wires, by using a high-pressure fluid mixed with an abrasive scavenging agent and to an apparatus therefor.

BACKGROUND ART

For example, in a process of hot-stretching steel wires by heating at a high temperature, a mill scale (black film) or a scale (oxide film) including the mill scale is generated on the surfaces. In order to remove these scales, a method now is employed according to which the scales are trimmed off by using a ring-shaped peeling blade before entering a wire-stretching die.

At present, further, a method of treatment with acid is frequently used in which metal wires in a pool of acid is dipped to dissolve and remove the scales.

Patent document 1: JP-A-2001-32042

DISCLOSURE OF THE INVENTION

Problems to be Solved by the Invention

Problems to be Solved by the Invention

In the conventional mechanical peeling process, however, the peeling blade is worn out in a certain period of time and must be replaced. Here, since the blade has a ring-like shape, it becomes necessary to once cut the wire to replace the blade, and thereafter, deposit the wire. In this case, however, the wire loses consistency of quality, for instance having unstable electric resistance at the deposited portion. Above all, laborious work is required, further, causing a large time loss and pushing up the cost. Further, the scales often remain without being completely peeled off, causing stains to be burnt in the wire-stretching die. In the conventional treatment with acid, further, cumbersome work is required for treating the acid after use, which pushes up the cost and undesirably affects the environment.

This invention has been achieved in view of the above background art, and has an object of providing a method of removing scales from metal wires capable of reliably removing oxide films on the surfaces of the stretched metal wires and an apparatus therefor, relying upon a simple method and apparatus.

Means for Solving the Problems

This invention is concerned with a method of removing scales formed on the surfaces of wires during a process of stretching metal wires by injecting a slurry of a liquid in which an abrasive scavenging agent is mixed together with a high-pressure fluid toward the surfaces of the metal wires from mixing nozzles that inject the high-pressure liquid, and bombarding the abrasive scavenging agent in the high-pressure injected liquid upon the scales on the surfaces of the metal wires to remove the scales.

As the abrasive scavenging agent, spherical fine particles having particle sizes of about 40 μm to about 800 μm are used. Spherical zircon beads, spherical zirconia beads or spherical stainless steel beads can be used as the spherical particles of the abrasive scavenging agent.

The liquid with which the abrasive scavenging agent is mixed is a liquid obtained by mixing a water-soluble cutting oil with water, and the high-pressure water mixed with the abrasive scavenging agent in the liquid is injected toward the surfaces of the metal wires.

The invention is, further, concerned with a metal wire scale removing apparatus for wire undergoing a process of stretching, to remove scales formed on the surfaces of the metal wires, comprising a liquid container tank through which metal wires pass, mixing nozzles disposed to allow the metal wirings to pass through the liquid container tank for injecting a high-pressure liquid toward the metal wires, a high-pressure pump for feeding the high-pressure liquid to the mixing nozzles, and a slurry feeder for feeding a slurry containing an abrasive scavenging agent mixed with a liquid to the mixing nozzles; wherein the mixing nozzles inject the slurry of the abrasive scavenging agent together with the high-pressure liquid so that the abrasive scavenging agent impinges upon the scales on the surfaces of the metal wires to remove the scales.

Provision is made of a separator for recovering the liquid with which the abrasive scavenging agent is mixed, and for separating the liquid and the abrasive scavenging agent from each other, the abrasive scavenging agent in slurry form being fed from the separator to the mixing nozzles, and provision is further made of a separating/recovering device such as a filter device for recovering the liquid from the separator and further separating the abrasive scavenging agent. The slurry feeder is used jointly with the separator.

The separating/recovering device includes a scale recovering device using magnets or the like for separating and recovering the removed scales in the liquid with which the abrasive scavenging agent is mixed. Further, the separating/recovering device includes a filter or a sedimentation tank for separating the abrasive scavenging agent in the liquid with which the abrasive scavenging agent is mixed, and feeds the liquid from which the abrasive scavenging agent and the scales have been removed to the high-pressure pump.

Effects of the Invention

By using the method of removing scales from the metal wires and the apparatus therefor of the invention, there is provided an apparatus for removing scales formed on the surfaces of the metal wires, which is inexpensive and efficient. By using the method of removing scales from the metal wires and the apparatus therefor of the invention, further, there is no need of conducting a very laborious step of replacing the blades that had to be done at regular intervals in the course of removing the scales, contributing to strikingly improving the production efficiency. By using the abrasive scavenging agent including particles of a spherical shape, further, the wires are not scratched as when wire brushes are used, and wires having stable quality can be supplied.

DESCRIPTION OF REFERENCE NUMERALS

Figure 1:
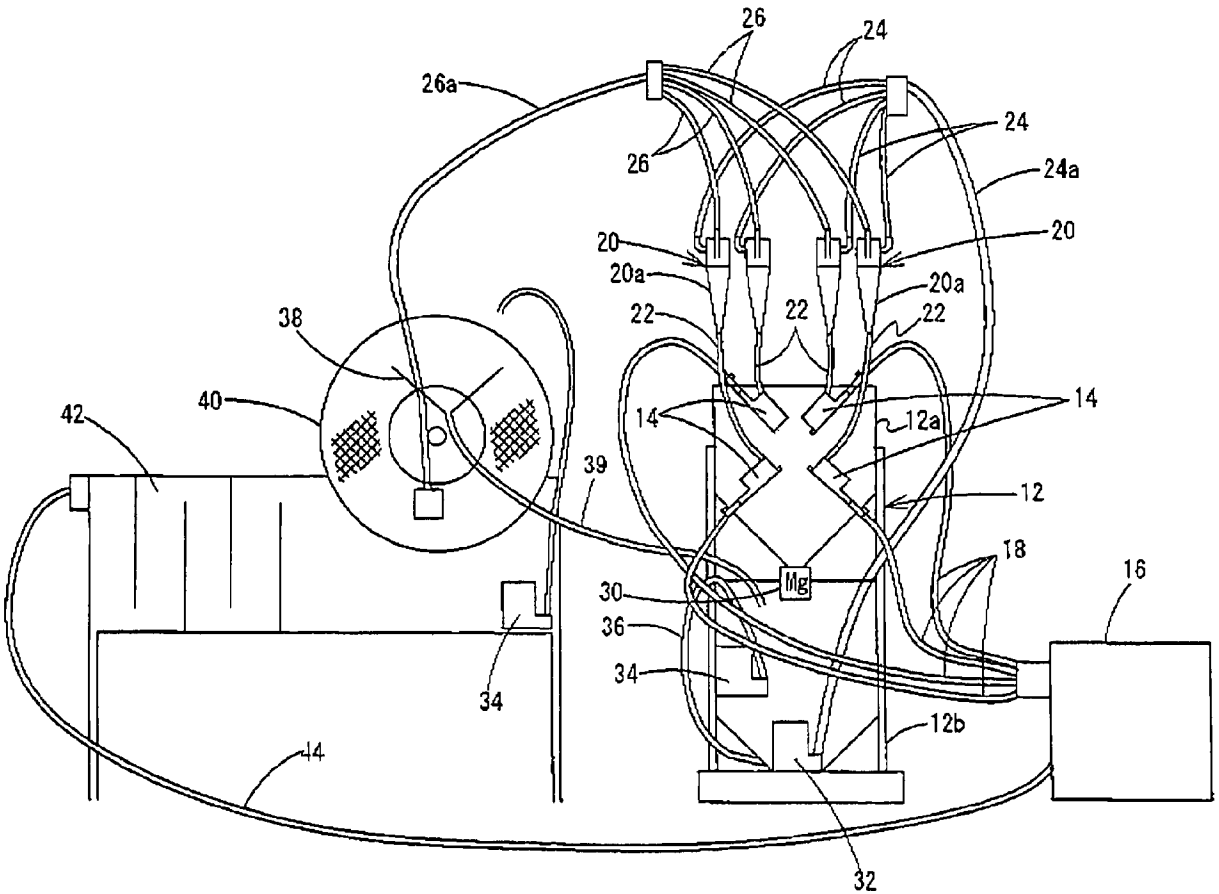
FIG. 1 is a view schematically illustrating the whole constitution of an apparatus for removing scales from metal wires according to an embodiment of the invention.

10 metal wire
12 liquid container tank

12*a* upper container portion
12*b* lower container portion
14 mixing nozzles
16 high-pressure pump
18 high-pressure hoses
20 cyclone separators
22 hoses
24 feed hoses
26 delivery hoses
30 magnets
32, 34 underwater pumps
40 wheel-type filter

BEST MODE FOR CARRYING OUT THE INVENTION

Figure 2:
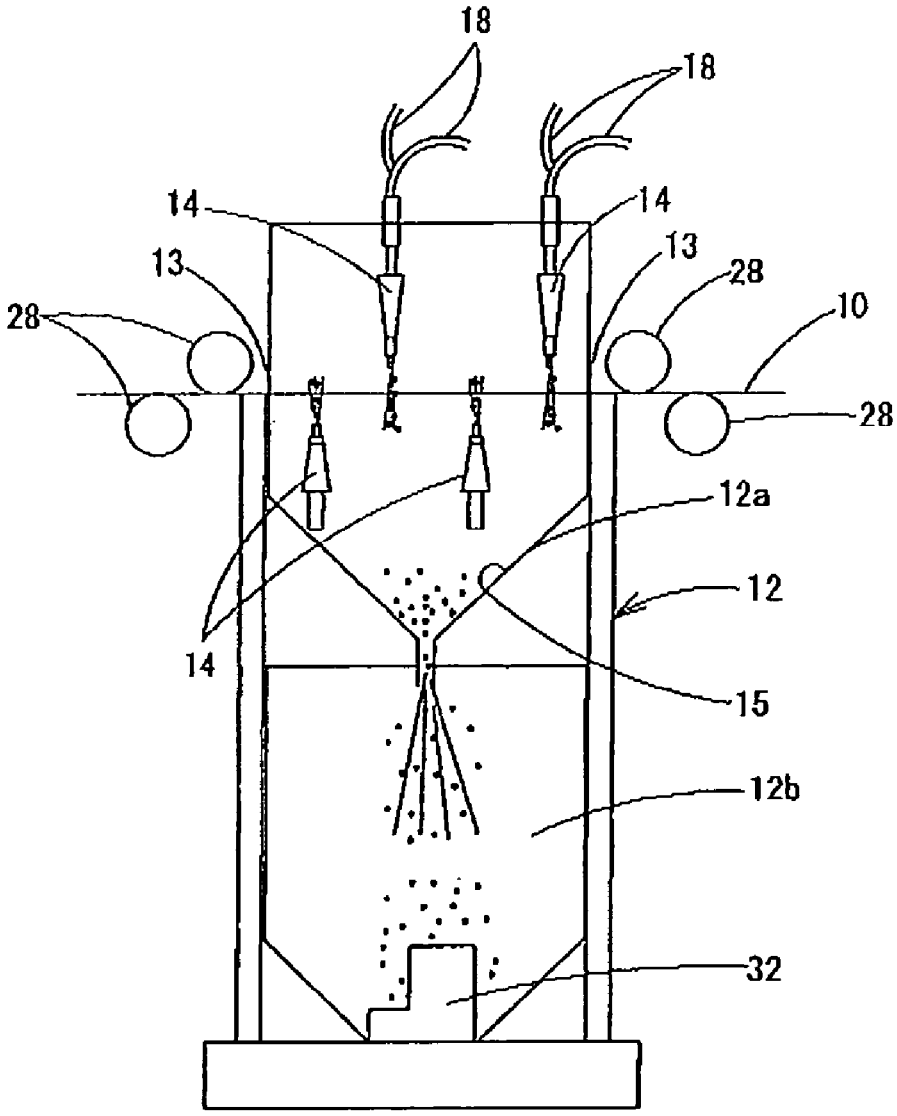
FIG. 2 is a vertical sectional view of the apparatus for removing scales from metal wires according to the embodiment.

An embodiment of the invention will now be described with reference to FIGS. 1 and 2. An apparatus for removing scales from metal wires of this embodiment is placed in a process of stretching a metal wires 10, to remove scales such as oxide films formed on the surfaces of the metal wires 10 such as steel wires. The apparatus for removing scales has a liquid container tank 12 in which the metal wires 10 pass. In the liquid container tank 12 are provided mixing nozzles 14 for injecting a high-pressure liquid to the metal wires 10, and a high-pressure pump 16 for feeding the high-pressure liquid to the mixing nozzles 14. The high-pressure pump 16 generates a high-pressure fluid of, for example, about 5 to 30 MPa. To the high-pressure pump 16 are connected a plurality of high-pressure hoses 18, for example, three to four, which are connected to the mixing nozzles 14 arranged at upper positions in the liquid container tank 12. The mixing nozzles 14 accelerate the velocity of flow to a speed close to the speed of sound.

The mixing nozzles 14 are positioned at upper portions of the liquid container tank 12, and cyclone separators 20 are positioned over them. The cyclone separators 20 work as an abrasive scavenging agent separating/recovering device and, further, work as a slurry feeder. That is, the cyclone separator 20 has a funnel-like container portion 20*a* which also works as a slurry feeder for separating the abrasive scavenging agent from the water with which the abrasive scavenging agent is mixed, for collecting the abrasive scavenging agent, for forming a slurry in which the abrasive scavenging agent is mixed with water, and for feeding the slurry to the mixing nozzle 14. A hole at the lower end of the container portion 20*a* is connected to the mixing nozzle 14 via the hose 22. To the container portion 20*a* is also connected a feed hose 24 for feeding the liquid in the lower layer of the liquid container tank 12. A delivery hose 26 is connected to an upper part of the container portion 20*a* of each cyclone separator 20 to deliver the liquid component separated by the cyclone separator 20 to a wheel-type filter 40 that will be described later. The feed hoses 24 are collected into one feed hose 24*a* and the delivery hoses 26 are collected into one delivery hose 26*a* for recovering the liquid component, at positions separated by predetermined distances from the cyclone separators 20, respectively.

The liquid container tank 12 is constituted by an upper container portion 12*a* and a lower container portion 12*b*. A pair of insertion holes 13 is liquid-tightly formed in the upper container portion 12*a* permitting the metal wire 10 to pass through, and guide rollers 28 are provided on both sides of the insertion holes 13. A tilted surface portion 15 tilted downward in a pyramidal shape is formed under the positions where the metal wire 10 passes through, a through hole is formed in the lower end of the tilted surface portion 15, and the liquid flows down through the through hole. Magnets 30 are arranged surrounding the through hole so as to adsorb and remove magnetic components. The lower container tank 12*b* is positioned under the magnets 30. An underwater pump 32 is disposed on the bottom surface of the lower container portion 12*b*, and the feed hoses 24 are connected thereto to feed the liquid to the cyclone separators 20. An underwater pump 34 is provided at a central portion, too, in the lower container portion 12*b* to suck the liquid into the lower container portion 12*b* and to circulate it into the lower layer through a hose 36.

The mixing nozzles 14 are arranged at four places at intervals of 90° with respect to the metal wire 10 within the upper container portion 12*a*, and displaced from each other by a given distance in a pass-through direction of the metal wirings. The angles of the mixing nozzles 14 with respect to the metal wire 10 can be suitably set depending upon the feeding speed of the metal wire 10, and are suitably adjusted in a range of from 30° to 150°. When the mixing nozzles 14 are arranged at three places, they may be arranged at the intervals of 120°, and the number of installed mixing nozzles and the intervals therebetween can be suitably set. If the nozzle diameter is $\phi$=D, a distance from the metal wire 10 to the mixing nozzle 14 is most effectively 20 D to 200 D. If injection is made at an angle counter to a direction in which the metal wire 10 travels, the area of contact increases and the relative speed increases to improve efficiency. In this way, the nozzle angle is suitably adjusted depending upon the speed of drawing the metal wire 10.

The wheel-type filter 40 provided at the outlet of the delivery hose 26 is positioned over the sedimentation tank 42, and recovers zircon beads which are the abrasive scavenging agent in the liquid. A receiving portion 38 is provided, and the abrasive scavenging agent is returned back to the liquid container tank 12 through the hose 39. Further, the zircon beads are settled in the sedimentation tank 42, and the liquid in the surface layer portion in the sedimentation tank 42 is circulated into the high-pressure pump 16 through the hose 44.

In this embodiment, the liquid that is used is produced by mixing a water-soluble cutting oil in water at a ratio of 1:50. The abrasive scavenging agent mixed into the water comprises spherical zircon ($ZrSiO_4$) particles of nearly completely spherical shape having a particle size of about 40 μm to about 800 μm and, preferably, 100 μm to about 400 μm. The spherical zircon beads that are used have a specific gravity of 3.8 and a Mohs hardness of about 7. The spherical zircon beads have a large specific gravity and readily settle. In order to disperse the abrasive scavenging agent of spherical zircon beads in water, therefore, the water with which the abrasive scavenging agent is mixed is circulated by using the underwater pump 34. Or, the water may be directly stirred by providing any other stirrer device in the water tank.

As the abrasive scavenging agent, there can be also used other zirconia (zirconium oxide: $ZrO_2$) beads having a high strength and a high toughness in addition to the zircon beads of spherical zircon. For example, there can be used yttria-stabilized zirconia ($ZrO_2Y_2O_3$). The yttria-stabilized zirconia has a high durability and a stable shape. Moreover, spherical stainless steel beads can often be used. The above beads can be suitably used depending upon the cases.

Next, described below is the operation of the apparatus for removing scales of the embodiment. Water with which the abrasive scavenging agent is mixed is delivered from the underwater pump 32 and fed into the cyclone separators 20 at four places through one feed hose 24*a* and then through the individual feed hoses 24. In the cyclone separators 20, water containing the abrasive scavenging agent whirls like a cyclone in the container portion 20*a*, and the abrasive scavenging agent collects along the funnel-like inner peripheral surface of the container portion 20*a*. The abrasive scavenging agent having a large specific weight collects on the inner peripheral surface of the container portion 20*a*, and is expelled in slurry form along the tilted surface through the small hole in the lower end. The slurry of water and abrasive scavenging agent from the container portion 20*a* is delivered to the mixing nozzles 14 through the hoses 22. On the other hand, delivery hoses 26 are connected to the upper central portions of the conical container portions 20*a* to suck the water that remains after the abrasive scavenging agent is forced to the inner surface of the conical container portions 20*a*, and to send the water to the wheel-type filter 40.

Water of a high pressure is fed from the high-pressure pump 16 to the mixing nozzles 14, and is injected from the nozzle tips at velocity of flow close to the speed of sound. Here, in the mixing nozzles 14, the slurry of the abrasive scavenging agent fed from the cyclone separators 20 is so mixed as to be sucked by water of high pressure, and a high-pressure injection stream containing the abrasive scavenging agent is injected from the nozzle tips.

The injection stream containing the abrasive scavenging agent injected at a high speed bombards the scales on the surface of the metal wire 10 and grinds the scales with the abrasive scavenging agent. Here, the abrasive scavenging agent comprising zircon beads of a spherical shape works to finish the metal wire 10 such as steel wire to have a flawless surface without scratching. In particular, the abrasive scavenging agent of spherical zircon beads which is a non-metal does not cause foreign metals to deposit on the metal wire 10 and suppresses the probability of corrosion of the metal wire 10.

In the upper container portion 12*a* of the liquid container tank 12, the abrasive scavenging agent falls down together with scales and water after having bombarded the surface of the metal wire 10, i.e., falls down along the tilted surface portion 15 of the upper container portion 12*a* into the lower container portion 12*b*. The magnetic components are attracted and removed by magnets 30 provided surrounding the through hole at the lower end of the upper container portion 12*a*. In the lower container portion 12*b*, the mixture of water and abrasive scavenging agent is sucked by the underwater pump 32, delivered to the cyclone separators 20 where it is separated into water and the slurry of abrasive scavenging agent due to the above described function.

Water sucked from the cyclone separators 20 is removed of about 90% of the abrasive scavenging agent. The abrasive scavenging agent is further removed by the wheel-type separator 40. However, water that is sent to the high-pressure pump 16 must be almost free of foreign matter. Therefore, the remaining water is fed into the sedimentation tank 42 where the abrasive scavenging agent is removed by sedimentation, and so water only is fed to the high-pressure pump 16 through the hose 44.

According to the apparatus for removing scales from the metal wires of this embodiment, high-pressure treating water from the high-pressure pump 1 is injected from the mixing nozzles 14 together with the spherical abrasive scavenging agent, bombards the surface of the metal wire 10 at high speeds, and instantaneously removes the scales from the surface without adversely affecting the metal wire 10.

Here, in addition to a tank that is divided into the upper container portion 12*a* and the lower container portion 12*b*, the liquid container tank 12 of the apparatus for removing scales of the metal wire of the invention may be the one that has only one container portion. Further, a liquid container tank 12 may be provided for each mixing nozzle 14.

The invention claimed is:

1. A method of removing scales formed on the surfaces of metal wires during a process of stretching the wires, comprising: injecting a slurry in which an abrasive scavenging agent is mixed with a liquid, together with a high-pressure fluid, toward the surfaces of the metal wires from mixing nozzles that inject the high-pressure liquid, and bombarding the abrasive scavenging agent in the liquid that is high-pressure injected on the scales on the surfaces of the metal wires to remove the scales, wherein spherical fine particles selected from the group consisting of spherical zircon beads, spherical zirconia beads and spherical stainless steel beads having particle sizes of from about 40 μm to about 800 μm are used as the abrasive scavenging agent and the liquid with which the abrasive scavenging agent is mixed is a liquid obtained by mixing a water-soluble cutting oil with water, and the high-pressure water containing the abrasive scavenging agent in the liquid is injected toward the surfaces of the metal wires.

2. An apparatus for removing scales from metal wires placed in a process of stretching the metal wires to remove scales formed on the surfaces of the metal wires, comprising: a liquid container tank through which the metal wires pass; mixing nozzles disposed to allow the metal wirings to pass through the liquid container tank for injecting a high-pressure liquid toward the metal wires; a high-pressure pump for feeding the high-pressure liquid to the mixing nozzles; and a slurry feeder for feeding a slurry in which an abrasive scavenging agent is mixed with a liquid to the mixing nozzles; wherein the mixing nozzles inject the slurry of the abrasive scavenging agent together with the high-pressure liquid so that the abrasive scavenging agent bombards the scales on the surfaces of the metal wires to remove the scales.

3. The apparatus for removing scales from metal wires according to claim 2, wherein provision is made of a separator for recovering the liquid with which the abrasive scavenging agent is mixed, and separating the liquid and the abrasive scavenging agent from each other so that the abrasive scavenging agent in slurry form is fed from the separator to the mixing nozzles, and provision is made of a separating/recovering device for recovering the liquid component from the separator and further separating the abrasive scavenging agent.

4. The apparatus for removing scales from metal wires according to claim 3, wherein the separating/recovering device includes a scale recovering device for separating and recovering the removed scales in the liquid with which the abrasive scavenging agent is mixed.

5. The apparatus for removing scales from metal wires according to claim 4, wherein the separating/recovering device includes a filter for separating the abrasive scavenging agent in the liquid with which the abrasive scavenging agent is mixed, and feeds the liquid from which the abrasive scavenging agent and the scales have been removed to the high-pressure pump.

* * * * *